United States Patent [19]

Goedicke

[11] 4,251,487

[45] * Feb. 17, 1981

[54] DEVICE FOR HOLDING A GRANULAR CATALYST

[75] Inventor: Eitel Goedicke, Ahe, Fed. Rep. of Germany

[73] Assignee: Hoechst Aktiengesellschaft, Frankfurt am Main, Fed. Rep. of Germany

[ * ] Notice: The portion of the term of this patent subsequent to Apr. 10, 1996, has been disclaimed.

[21] Appl. No.: 29,256

[22] Filed: Apr. 11, 1979

Related U.S. Application Data

[63] Continuation of Ser. No. 858,631, Dec. 8, 1977, abandoned.

[30] Foreign Application Priority Data

Dec. 9, 1976 [DE] Fed. Rep. of Germany ..... 2655750

[51] Int. Cl.[3] ..... B01J 8/02; F01N 3/28

[52] U.S. Cl. ..... 422/179; 422/181

[58] Field of Search ..... 60/299, 322; 422/179, 422/181

[56] References Cited

U.S. PATENT DOCUMENTS

| | | | |
|---|---|---|---|
| 3,024,593 | 3/1962 | Houdry | 422/179 |
| 3,421,826 | 1/1969 | Tope et al. | 422/181 |
| 3,751,917 | 8/1973 | Garcea | 422/181 |
| 3,902,853 | 9/1975 | Marsee et al. | 422/179 |
| 3,920,404 | 11/1975 | Gandhi et al. | 422/181 |
| 3,957,446 | 5/1976 | Mayer et al. | 422/181 |
| 4,078,898 | 3/1978 | Fedor et al. | 422/181 |
| 4,148,860 | 4/1979 | Goedicke | 422/181 |

FOREIGN PATENT DOCUMENTS

| | | | |
|---|---|---|---|
| 2225715 | 12/1972 | Fed. Rep. of Germany | 422/181 |

*Primary Examiner*—Bradley Garris

*Attorney, Agent, or Firm*—Connolly and Hutz

[57] ABSTRACT

Device for holding a granular catalyst suitable for use in the decontamination of the exhaust gas of an internal combustion engine. The device comprises a housing which comprises a jacket closed by means of end plates and which is provided with a gas inlet and gas outlet, and which has disposed therein a sleeve having an annular cross-section and having perforated walls, this sleeve being disposed substantially concentrically with respect to the gas inlet. In the device at least one end-plate-facing terminal portion of the sleeve, and also the lateral wall of the sleeve, are slidably mounted relative to the jacket of the housing, so as to accommodate axial relative movements.

10 Claims, 6 Drawing Figures

DEVICE FOR HOLDING A GRANULAR CATALYST

Figure 1:
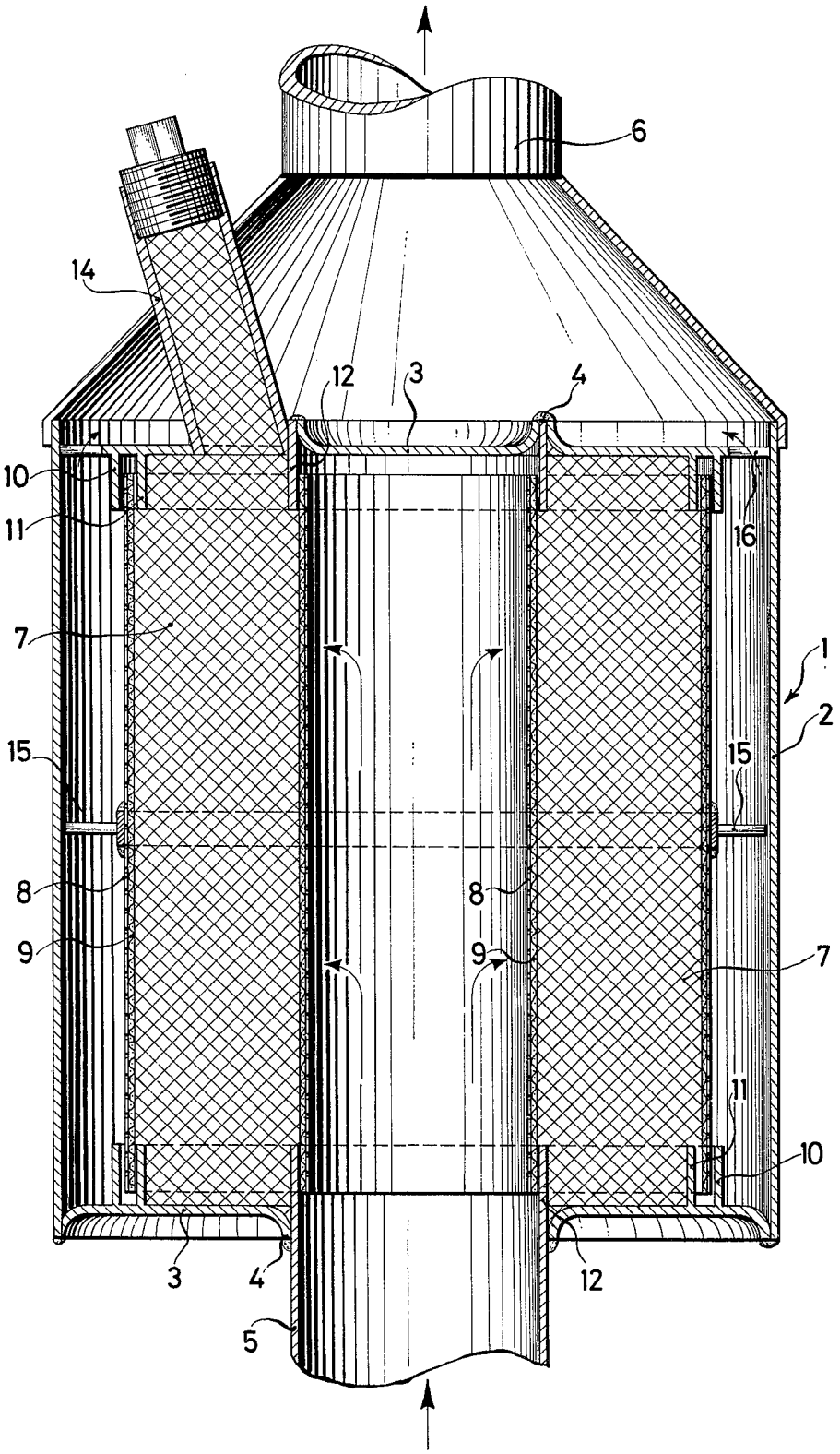

This application is a continuation of copending application to U.S. Pat. Ser. No. 858,631, filed Dec. 8, 1977, now abandoned.

This invention relates to a device for holding a granular catalyst suitable for use in the decontamination of the exhaust gas of an internal combustion engine, the device comprising a housing which comprises a jacket closed by means of end plates and which is provided with a gas inlet and gas outlet, and which has disposed therein a sleeve having an annular cross-section and having perforated walls, this sleeve being disposed substantially concentrically with respect to the gas inlet. The catalyst employed is charged into the space between the inner and outer walls of the sleeve.

Various catalysts which permit noxious constituents of the exhaust gas of a combustion engine to be transformed into harmless compounds have already been described. These catalysts may be used in the form of a monolithic structure or in the form of granular material, e.g. pellets or moulded pieces.

As a result of the conditions which prevail in an internal combustion engine and which entail temperature changes and mechanical vibration, the catalysts are subject to heavy stress. In the case of a granular catalyst, which is normally placed in a metallic container, it is naturally necessary to consider the different thermal expansion coefficients of the metallic container on the one hand and of the granular catalyst on the other. The different thermal expansion of container and catalyst is of particular importance if the exhaust gas decontamination device is one in which temperatures of 1000° C. and more may occur, as in the case of a device disposed in the vicinity of the respective engine, inasmuch as the catalyst granules undergo less thermal expansion than the container so that it is possible for them to move freely within the container to an increasing extent with increasing temperatures. In this situation, the catalyst granules are subject to abrasion, which means loss of catalyst, and, in the end, inoperativeness of the exhaust gas decontamination device.

U.S. Pat. No. 3,449,086 describes a catalyst-containing silencer which comprises a housing closed by means of end plates having a gas inlet and gas outlet passed therethrough. Disposed in the interior of the housing is a sleeve having an annular cross-section and having perforated walls, this sleeve being intended to hold a granular catalyst. More specifically, the inside wall of the sleeve is arranged so as to be in alignment with the gas outlet. At one end the sleeve is connected to the end plate on the gas inlet side, and the other end of the sleeve is closed by means of a cap which in turn is securely bolted to the end plate on the gas outlet side.

In the device just described, the sleeve is rigidly connected to the two end plates of the housing. This, however, is disadvantageous, for the following reason. During operation of the silencer, the perforated walls of the sleeve are heated to markedly higher temperatures than the housing, so that these metal structures undergo different thermal expansion and stress which is liable to cause warping or breakage of the metallic material concerned. Furthermore, the housing and catalyst also undergo different thermal expansion, so that cavities, which permit abrasion, are liable to be formed in the catalyst bed.

It is therefore an object of the present invention to provide a device as first mentioned herein for holding a granular catalyst suitable for use in the decontamination of the exhaust gas of an internal combustion engine, which is adapted substantially to avoid (1) the occurrence of thermal stress phenomena between the housing and the sleeve, which would be liable to cause breakage of the material concerned, and (2) the formation of cavities in the catalyst bed, which would be liable to permit catalyst abrasion.

According to the present invention, we provide a device for holding a granular catalyst suitable for use in the decontamination of the exhaust gas of an internal combustion engine, the device comprising a housing which comprises a jacket closed by means of end plates and which is provided with a gas inlet and gas outlet, and which has disposed therein a sleeve having an annular cross-section and having perforated walls, this sleeve being disposed substantially concentrically with respect to the gas inlet, in which device at least one end-plate-facing terminal portion of the sleeve, and also the lateral wall of the sleeve, are slidably mounted relative to the jacket of the housing, so as to accommodate axial relative movements.

Preferred features of the present invention provide:

(a) for three metal collars to be secured to at least one end plate, one of the walls of the sleeve being supported between two of the metal collars and the other wall of the sleeve being slidable on the third metal collar;

(b) for four metal collars to be secured to at least one end plate, the outside wall of the sleeve being supported between the two outer metal collars, and the inside wall of the sleeve being supported between the two inner metal collars;

(c) for one of the walls of the sleeve to be slidable on a metal collar which is fixed to a respective end plate, and for the other wall of the sleeve to be supported by means of a protuberance formed in the respective end plate;

(d) for the metal collar of case "(c)" or at least one of the metal collars of case "(a)" or "(b)", to be secured to a protuberance formed in the respective end plate;

(e) for the outside wall and inside wall of the sleeve to be each supported by a protuberance formed in the respective end plate;

(f) for at least one spacer sliding on the inside wall of the jacket to be secured to the outside wall of the sleeve;

(g) for the spacer, or at least one of the spacers, of case "(f)" to comprise an annular apertured sheet;

(h) for the spacer, or at least one of the spacers, of case "(f)" to comprise a plurality of bolts which are arranged around the periphery of the sleeve so as to be laterally spaced from each other;

(i) for at least one of the end plates to be provided, within the region bounded by the sleeve, with a closable catalyst inlet;

(j) for the walls of the sleeve to comprise a perforated sheet having a wire gauze secured to its catalyst-facing side;

(k) for the width of the openings of the wire gauze of case "(j)" to be equal to 10 to 90% of the width of the openings of the adjacent perforated sheet;

(l) for the wire gauze of case "(j)" or "(k)" to have meshes 0.5 to 2 mm wide;

(m) for the wire gauze of case "(j)" "(k)" or "(l)" to have a wire diameter of 0.5 to 1.5 mm;

(n) for each perforated sheet of case "(j)", "(k)", "(l)" or "(m)" to have a thickness of 0.7 to 2 mm, preferably 0.9 to 1.5 mm.

If merely a single metal collar is provided for a given wall of the sleeve, it is particularly advantageous for the collar in question to be mounted on the catalyst inlet side of that wall. This helps to prevent abrasion of the catalyst granules, and thus helps to avoid the formation of abraded fines and the formation of cavities in the catalyst bed which is associated with catalyst abrasion.

By the use of high-temperature-resistant perforated sheet metal in combination with heat-resistant fine-meshed wire gauze in case "(j)" above, it is possible to give the sleeve adequate strength for working temperatures up to about 1000° C., and to substantially avoid the abrasion of those catalyst granules which in the absence of the gauze would come into contact with the sharp edges of the perforated metal sheet. The diameter of the openings of the perforated metal sheet just mentioned, which is most preferably about 1 mm thick, and which confers heat resistance upon the sleeve, may be as large as may be found desirable in the interest of providing a large unobstructed cross-sectional area for the arriving gas. The fine-meshed wire gauze just mentioned, being free from sharp edges, is substantially not liable to cause abrasion of the catalyst granules which come into contact therewith. In addition to this, it effectively prevents catalyst particles from escaping from the sleeve into the region(s) of the housing other than that within the sleeve. It further acts similarly to a spacer or distributor relative to the perforated metal sheet, whereby it is possible for the arriving exhaust gas to uniformly contact the catalyst bed and travel therethrough substantially without any significant decrease in pressure.

Figure 2:
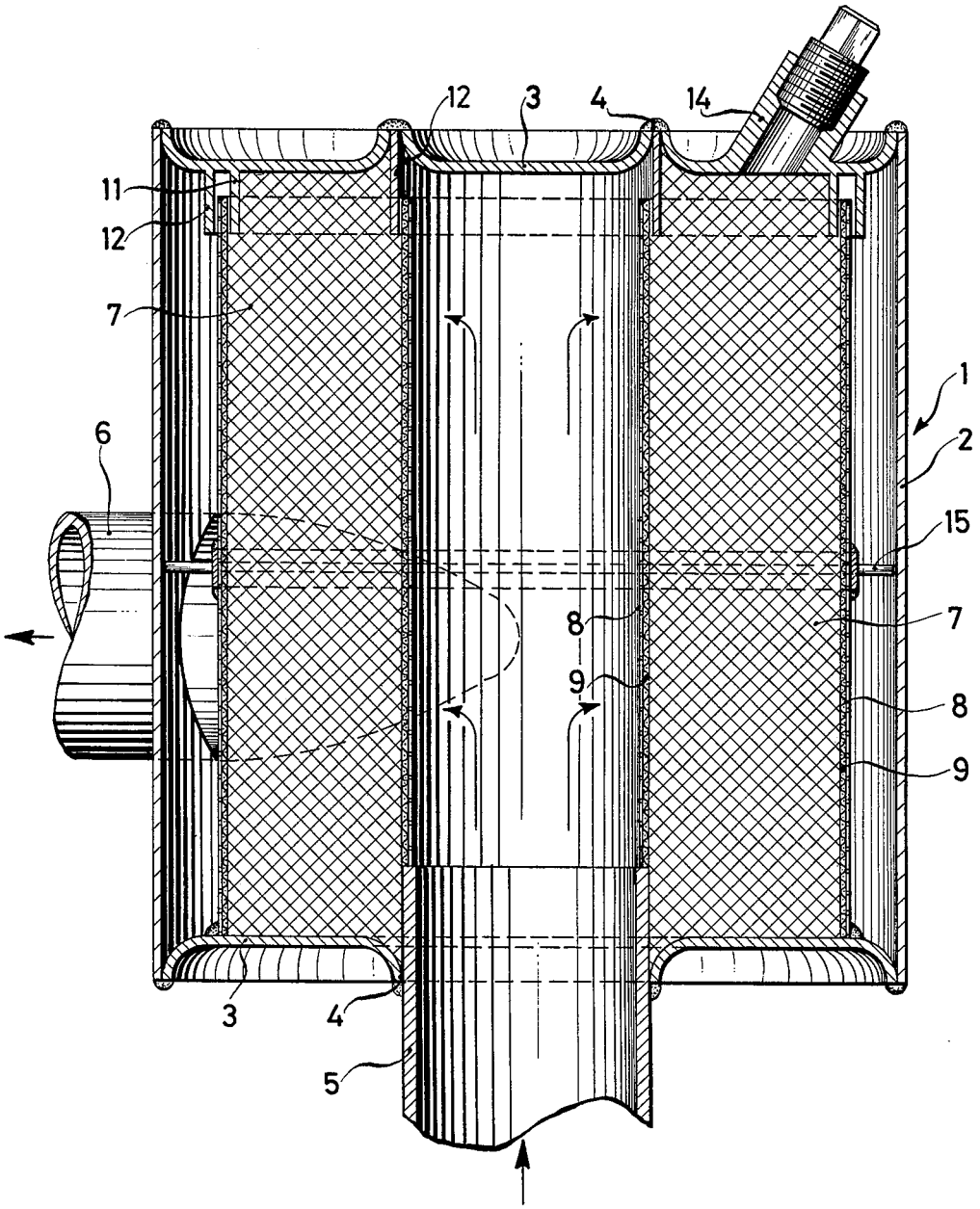

Two preferred basic forms of the device of the present invention, and four systems for mounting the sleeve, are shown in the accompanying diagrammatic drawings, in which:

FIG. 1 is a side view, mostly in axial section, of a device wherein the gas inlet and gas outlet are parallel with one another, and wherein both terminal portions of the sleeve are slidably mounted on the respective end plates;

FIG. 2 is a similar view of a device wherein the gas inlet and gas outlet are disposed transversely with respect to each other, and wherein only one of the terminal portions of the sleeve is slidably mounted on the respective end plate; and FIGS. 3 to 6 are fragmentary side views in axial section which show four systems for the slidable mounting of one of the terminal portions of the sleeve on the respective end plate.

In the devices shown in FIGS. 1 and 2, a jacket 2 of a housing 1 is closed by means of end plates 3 which are formed with protuberances 4 directed towards the outside. The housing 1 is provided with a gas inlet 5 and a gas outlet 6. Placed in the interior of the housing 1, concentrically with respect to the gas inlet 5, is a sleeve 7 of annular cross-section which is packed with granular catalyst 17. The sleeve 7 has perforated walls 8 which have a wire gauze 9 secured to their catalyst-facing sides. Secured to the inside of at least one of the end plates 3 are metal collars 10, 11, 12, which slidingly engage the terminal portions of the sleeve 7 to accommodate axial relative movements. The metal collar 12 may be placed (cf. FIG. 1) by the gas inlet 5 which in this event is provided with an extension reaching into the interior of the housing 1. To accommodate radial and axial relative movements of the sleeve 7, there are disposed, between the inside wall of the jacket 2 and the outside wall of the sleeve 7, a plurality of spacers 15 which are axially spaced from each other. The spacers 15 are secured to the outside wall of the sleeve 7 but are free to slide on the inside wall of the jacket 2. The spacers 15 may comprise an annular apertured metal sheet, or again they may comprise a plurality of bolts which are arranged around the periphery of the sleeve so as to be laterally spaced from each other.

At least one of the end plates 3 is provided, within the region bounded by the sleeve 7, with a closable inlet 14 permitting the sleeve 7 to be filled, and indeed packed, with the catalyst.

As shown in FIG. 1, one of the end plates 3 is provided near its periphery with apertures 16 through which decontaminated gas is delivered to the gas outlet 6.

Figure 3:
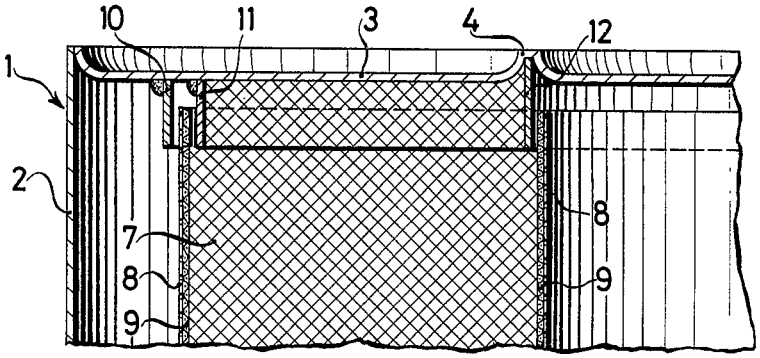
Figure 4:
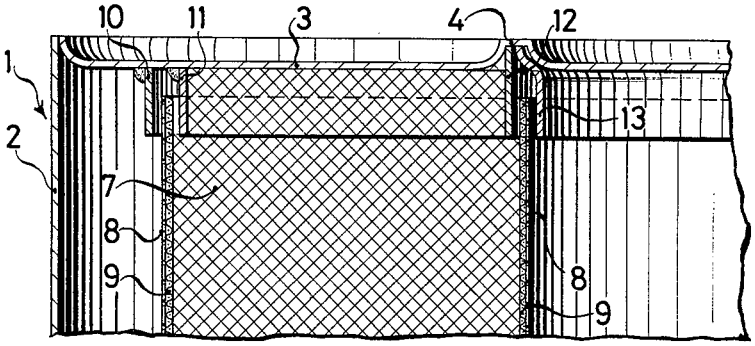

FIG. 3 shows the same slidable mounting system as FIGS. 1 and 2, but, in the system of FIG. 4, the two walls of the sleeve 7 are each slidingly mounted on two metal collars, shown at 10 and 11 for the outer wall, and at 12 and 13 for the inner wall. The two inner metal collars 12 and 13 are secured to one of the protuberances 4.

Figure 5:
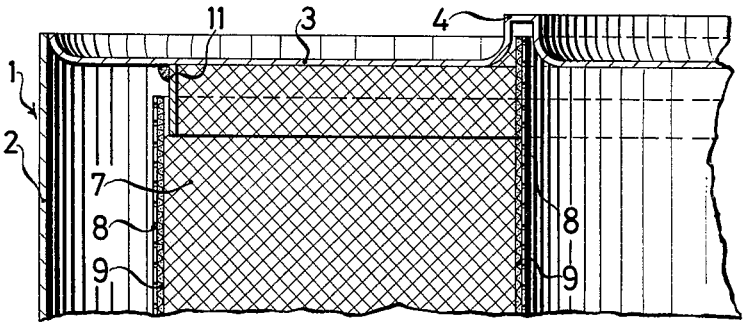

In the system of FIG. 5, one of the walls of the sleeve 7 is slidably mounted on the metal collar 11, but its other wall is supported by one of the protuberances 4.

Figure 6:
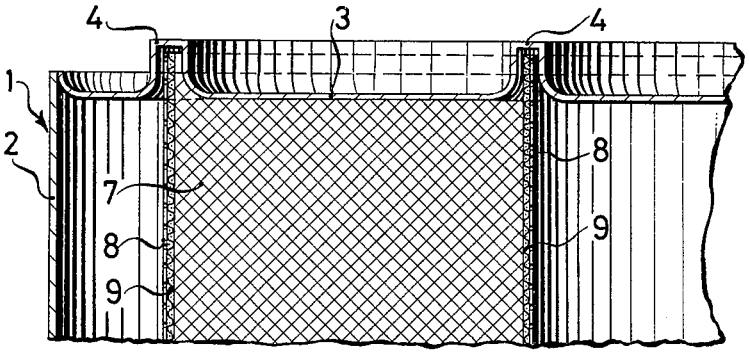

In the system of FIG. 6, the two walls of the sleeve 7 are each slidably mounted by means of a protuberance 4.

I claim:

1. In a converter for catalytic conversion of exhaust gas from internal combustion engines comprising a housing closed by an upper and a lower end plate, said upper end plate being provided near its periphery with a plurality of apertures for delivering purified gas to a gas outlet flanged to said housing's upper end, said lower end plate being centrally penetrated by a gas inlet being provided with an extension reaching into the interior of said housing; said housing being provided with an inner metal collar being secured substantially perpendicular to said upper end plate and within said extension of said gas inlet, respectively; an inner perforated tube being disposed slidably within the inner metal collar to accommodate axial relative movement between the inner perforated tube and the inner metal collar, said housing being further provided with an outer perforated tube, an outer metal collar and a middle metal collar spaced apart from one another and being secured substantially perpendicularly to said upper and to said lower end plate, respectively; the outer perforated tube being arranged slidably between the outer metal collar and the middle metal collar for accommodating relative axial movement between the outer perforated tube and the outer and middle metal collars; said outer perforated tube being slidable on said housing's inside wall by means of at least one spacer being secured substantially perpendicular to the periphery of said outer perforated tube to accommodate relative axial movement between the spacer and the housing; said inner and said outer perforated tube being spaced apart with respect to one another forming an annular space therebetween, and said annular space being filled by catalyst granules forming a bed; said outer perforated tube and said inner perforated tube, respectively, being made up of perforated sheet metal having a wire mesh secured to its catalyst-facing side; the improvement according to which said perforated sheet metal has a thickness of 0.7 to 2 mm, said wire mesh with meshes 0.5 to 2 mm wide being provided with openings equal to 10 to 90% of the width of the openings of said perforated sheet metal, and being produced from wires having a diameter of 0.5 to 1.5 mm.

2. The converter as claimed in claim 1, wherein said perforated sheet metal has a thickness of 0.9 to 1.5 mm.

3. The converter as claimed in claim 1, wherein an additional metal collar is secured substantially perpendicularly to at least one of said end plates, said additional metal collar being spaced apart from, and inside, said inner metal collar; and wherein said inner perforated tube is slidably arranged between said additional and said inner metal collar to accommodate relative axial movement therebetween.

4. The converter as claimed in claim 1, wherein at least one of said metal collars is secured to a protuberance formed in at least one of said end plates.

5. The converter as claimed in claim 1, wherein at least one of said end plates is provided, within a region of said annular space formed between said inner and said outer perforated tube, with a closable catalyst inlet.

6. In a converter for catalytic conversion of exhaust gas from internal combustion engines comprising a housing closed by an upper and a lower end plate, said lower end plate being penetrated by a gas inlet being provided with an extension reaching in the interior of said housing; said housing being provided with a gas outlet opening thereinto substantially perpendicularly with respect to said gas inlet; said housing being further provided with an inner perforated tube being connected to said extension of said gas inlet, an inner metal collar being secured substantially perpendicularly to said upper end plate; the inner perforated tube being disposed slidably within the inner metal collar to accommodate relative axial movement therebetween, said housing being finally provided with an outer perforated tube being secured to said lower end plate, an outer metal collar and a middle metal collar spaced apart from one another and being secured substantially perpendicularly to said upper end plate; the outer perforated tube being slidably arranged between the outer metal collar and the middle metal collar to accommodate relative axial movement; said outer perforated tube being slidable on said housing's inside wall to accommodate relative axial movement by means of at least one spacer, the spacer being secured substantially perpendicularly to the periphery of said outer perforated tube; said outer and said inner tube being spaced apart with respect to one another forming an annular space therebetween, and said annular space being filled by catalyst granules forming a bed; said outer perforated tube and said inner perforated tube, respectively, being made up of a perforated sheet metal having a wire mesh secured to its catalyst-facing side; the improvement according to which said perforated sheet metal has a thickness of 0.7 to 2 mm, said wire mesh with meshes 0.5 to 2 mm wide being provided with openings equal to 10 to 90% of the width of the openings of said perforated sheet metal, and being produced from wires having a diameter of 0.5 to 1.5 mm.

7. The converter as claimed in claim 6, wherein said perforated sheet metal has a thickness of 0.9 to 1.5 mm.

8. The converter as claimed in claim 6, wherein an additional metal collar is secured substantially perpendicularly to at least one of said end plates, said additional metal collar being spaced apart from, and inside, said inner metal collar; and wherein said inner perforated tube is arranged between said additional and said inner metal collars.

9. The converter as claimed in claim 6, wherein at least one of said metal collars is secured to a protuberance formed in at least one of said end plates.

10. The converter as claimed in claim 6, wherein at least one of said end plates is provided, within a region of said annular space formed between said inner and said outer perforated tube, with a closable catalyst inlet.

* * * * *